US009689601B2

(12) United States Patent
Hsu

(10) Patent No.: US 9,689,601 B2
(45) Date of Patent: Jun. 27, 2017

(54) BAG SEALER AND ICE VENDING MACHINE USING THE SAME

(75) Inventor: Yung-Shung Hsu, Dongguan (CN)

(73) Assignee: DONGGUAN JIA FENG MECHANICAL EQUIPMENT CO., LTD., Dongguan (CN)

( * ) Notice: Subject to any disclaimer, the term of this patent is extended or adjusted under 35 U.S.C. 154(b) by 786 days.

(21) Appl. No.: 13/086,502

(22) Filed: Apr. 14, 2011

(65) Prior Publication Data

US 2012/0111449 A1 May 10, 2012

(30) Foreign Application Priority Data

Nov. 10, 2010 (CN) ..... 2010 1 0537816

(51) Int. Cl.

| | |
|---|---|
| ***F25C 5/00*** | (2006.01) |
| ***B65B 1/10*** | (2006.01) |
| ***B65B 1/32*** | (2006.01) |
| ***B65B 43/30*** | (2006.01) |
| ***B65B 51/14*** | (2006.01) |
| ***B65B 57/00*** | (2006.01) |

(52) U.S. Cl.

CPC ..... *F25C 5/002* (2013.01); *B65B 1/10* (2013.01); *B65B 1/32* (2013.01); *B65B 43/30* (2013.01); *B65B 51/146* (2013.01); *B65B 57/00* (2013.01)

(58) Field of Classification Search

CPC ..... B65B 43/465; B65B 43/30; B65B 51/146; F25C 5/002; F25C 5/16; F25C 5/18

USPC ..... 53/570, 574

See application file for complete search history.

(56) References Cited

U.S. PATENT DOCUMENTS

| | | | | |
|---|---|---|---|---|
| 2,601,480 | A * | 6/1952 | Williams | B65B 43/36 493/255 |
| 3,398,503 | A * | 8/1968 | Bertoglio | B65B 3/323 53/386.1 |
| 3,789,570 | A * | 2/1974 | Mullins, Jr. | B65B 43/28 53/284.7 |
| 3,943,687 | A * | 3/1976 | Cerioni | B65B 43/18 53/386.1 |
| 5,140,801 | A * | 8/1992 | Wild | B65B 43/30 141/157 |
| 5,581,982 | A * | 12/1996 | Schroeder et al. | 53/459 |
| 5,822,955 | A * | 10/1998 | Woosley | B65B 3/28 53/384.1 |
| 6,112,539 | A * | 9/2000 | Colberg | F25C 5/007 62/331 |
| 8,484,935 | B2 * | 7/2013 | LeBlanc | B65B 1/36 53/440 |
| 9,428,289 | B2 * | 8/2016 | Pape | B65B 9/023 |
| 2008/0110129 | A1 * | 5/2008 | LeBlanc | B65B 1/36 53/127 |

* cited by examiner

*Primary Examiner* — Andrew M Tecco
(74) *Attorney, Agent, or Firm* — Gokalp Bayramoglu

(57) ABSTRACT

A bag sealer and an ice vending machine using the same are provided. The ice vending machine includes an ice making module, an ice storage bin, a bag sealer, and an ice guiding mechanism. The ice storage bin is located below the ice making module and used for storing the ice manufactured from the ice making module. The ice guiding mechanism is disposed between the ice storage bin and the bag sealer. The ice guiding mechanism is used for guiding the ice from the ice storage bin into the bag sealer. Because a cutting tool of the bag sealer is using the first electrothermal element to cut the roll of the plastic bags, the bag sealer can be installed in the ice vending machine.

13 Claims, 6 Drawing Sheets

BAG SEALER AND ICE VENDING MACHINE USING THE SAME

FIELD OF INVENTION

The invention relates to a bag sealer and an ice vending machine using the same.

BACKGROUND OF THE INVENTION

At present, many products served by the vending machine are packaged at the factories in advance, and the packaged products are transported by logistics and loaded into vending machines later on. For example, a liquid beverage is filled into a plurality of canned containers ahead of time, and then the canned containers containing the beverage are transported and loaded into vending machines.

However, for certain products, using the aforementioned described method will cause great inconvenience. For example, if the product to be sold is, for example, ice cubes, the vender must pay attention to the thermal insulation for the ice cubes during the transportation and loading periods, so as to prevent the ice cube from being melted. Since the installation of the thermal insulation facilities requires a certain added cost, thereby a considerable burden is brought onto the vendor of ice cubes.

Hence, there is a need in the art for decreasing the thermal insulation costs of vending machines.

SUMMARY OF THE INVENTION

One object of the present invention is to provide a bag sealer and an ice vending machine using the bag sealer. The bag sealer can be installed in the ice vending machine.

To achieve the foregoing and other objects, a bag sealer is disclosed. The bag sealer includes a main body, an entrance opening, a reel, a cutting tool, a suction cup assembly, and a bag sealing mechanism. The entrance opening is positioned above and connected to the main body. The products can slide through the entrance opening and be dropped into the main body. The reel includes a roller, on which plastic bags on a roll are wound. Some part plastic bags on a roll are drawn down to the interior of the main body. The cutting tool is disposed in the main body. The cutting tool includes a first electrothermal element which extends along a first direction and is configured to move along a second direction. The second direction is perpendicular to the first direction. The suction cup assembly is disposed in the main body and below the cutting tool. The suction cup assembly includes a first suction cup and a second suction cup. The first suction cup and the second suction cup are facing in the opposite directions to each other. Both the first suction cup and the second suction cup are configured to move along the first direction. The bag sealing mechanism includes a second electrothermal element and is positioned below the suction cup assembly. The second electrothermal element extends along the second direction.

To achieve the foregoing and other object, an ice vending machine is provided. The ice vending machine includes an ice making module, an ice storage bin, a bag sealer, and an ice guiding mechanism. The ice storage bin is located below the ice making module and used for storing the ice manufactured from the ice making module. The ice guiding mechanism is disposed between the ice storage bin and the bag sealer. The ice guiding mechanism is used for guiding the ice from the ice storage bin into the bag sealer.

The above and other aspects, features, and advantages of the present invention will become more apparent from the following detailed description when taken in conjunction with the accompanying drawings.

DETAILED DESCRIPTION OF THE INVENTION

Figure 1:
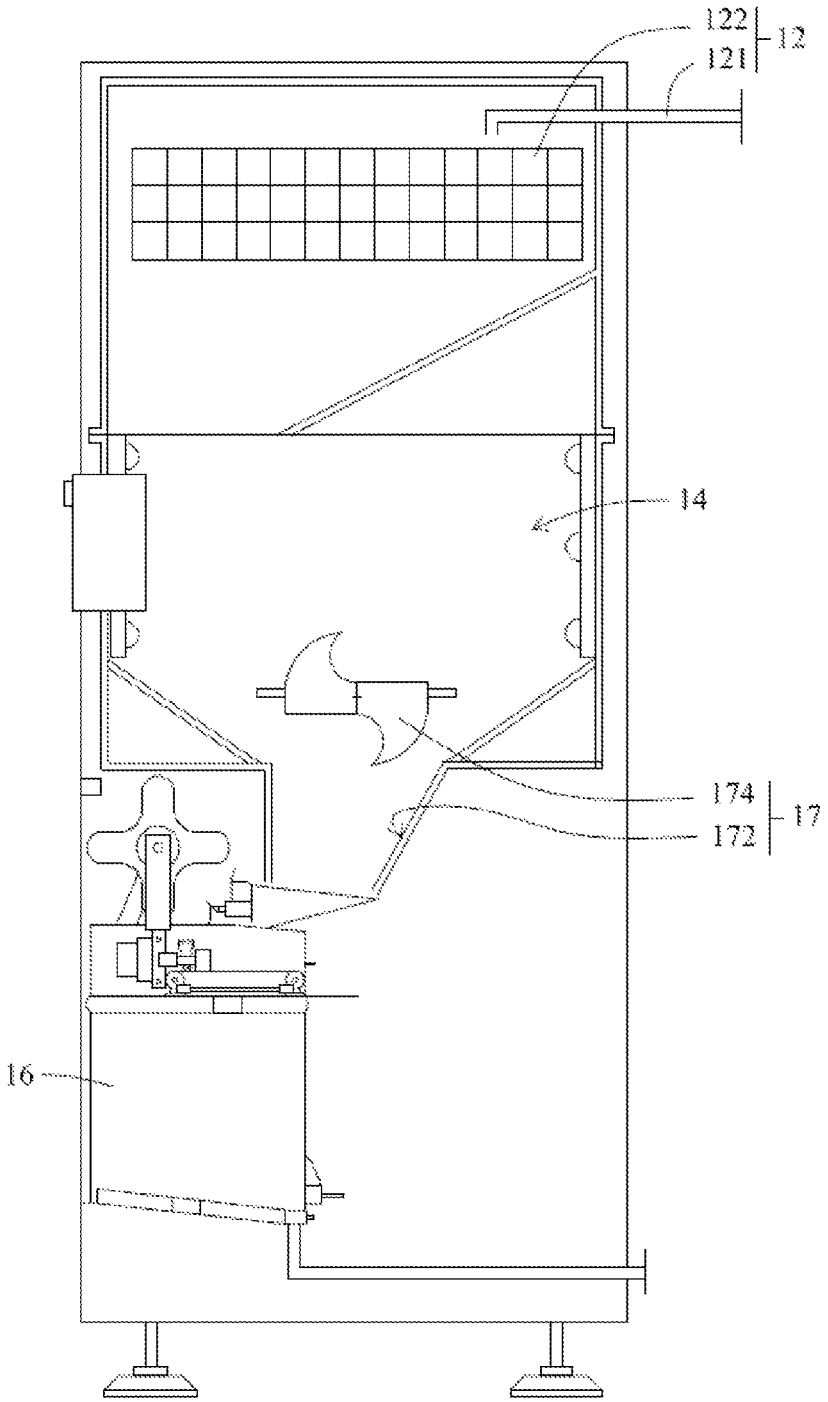
FIG. 1 shows an embodiment of the ice vending machine in the instant disclosure.

Please refer to FIG. 1, which shows an embodiment of an ice vending machine 1 in the instant disclosure. The ice vending machine 1 includes an ice making module 12, an ice storage bin 14, a bag sealer 16, and an ice guiding mechanism 17. The ice making module 12 includes an inlet pipe 121 and an evaporator 122. Via the inlet pipe 121, liquid water from the exterior of the ice vending machine 1 is delivered through a water filter (not shown) and then filled into the evaporator 122. The ice cubes produced in the ice making module 12 are dropped into the ice storage bin 14. A thermal insulation material (not shown) is installed in the ice storage bin 14 to prevent the ice cubes from being melted. The ice guiding mechanism 17, which is located between the ice storage bin 14 and the bag sealer 16, includes an ice guiding trough 172 and a hob cutter 174. The ice guiding trough 172 is located between the ice storage bin 14 and the bag sealer 16. The hob cutter 174 is disposed at the inlet of the ice guiding trough 172. When the hob cutter 174 is in a stationary state, the ice cubes are held in the ice storage bin 14. When the hob cutter 174 is rotated, the ice cubes in the ice storage bin 14 are transported to the ice guiding trough 172. Through the ice guiding trough 172, the ice cubes in the ice storage bin 14 are then slid into the bag sealer 16.

Figure 2:
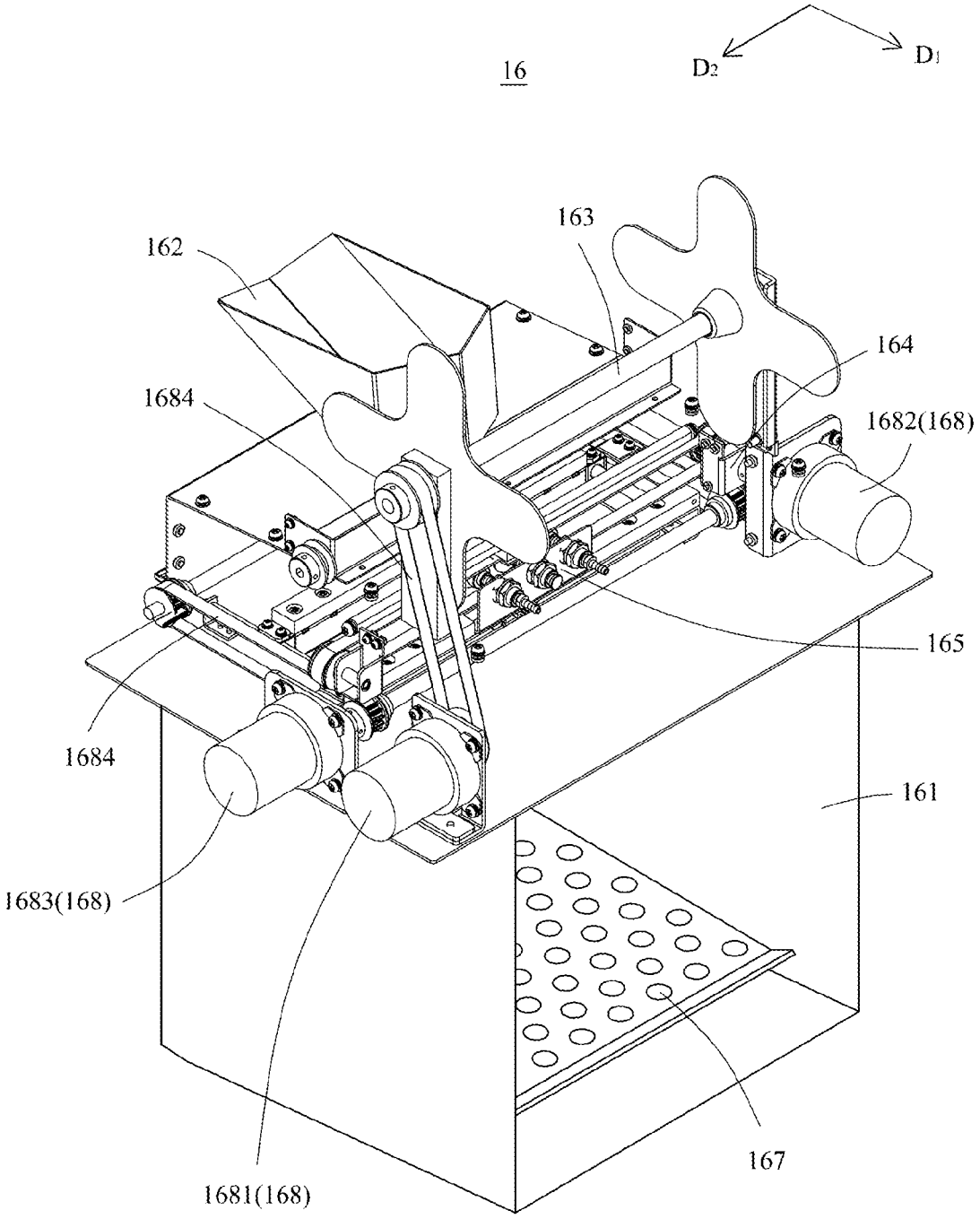
FIG. 2 shows the embodiment of the bag sealer in the instant disclosure.
Figure 3:
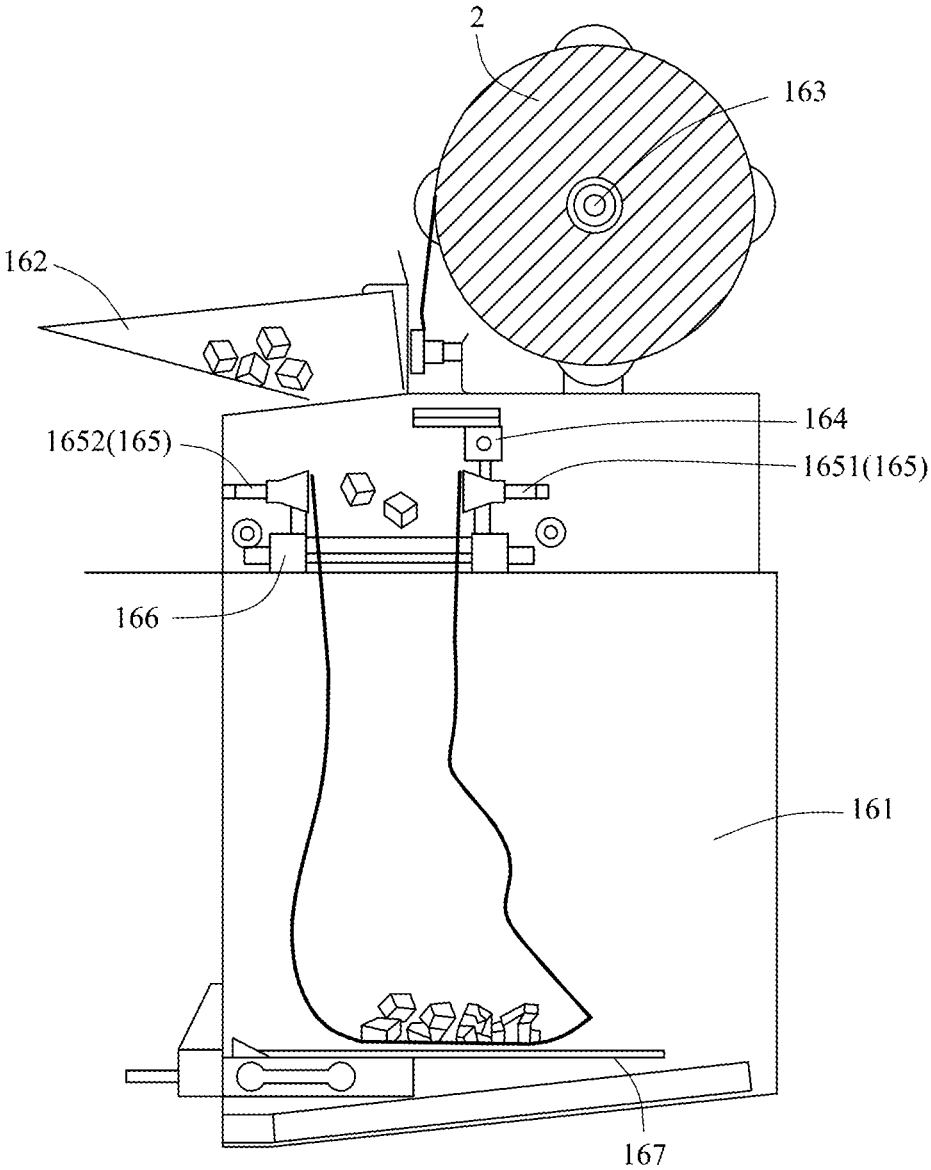
FIG. 3 shows the side view of the bag sealer.

Thereinafter, the composition and operation of the bag sealer 16 is described in detail. Please refer to FIG. 2 and FIG. 3. FIG. 2 shows the embodiment of the bag sealer in the instant disclosure. FIG. 3 shows the side view of the bag sealer. The bag sealer 16 includes a main body 161, an entrance opening 162, a reel 163, a cutting tool 164, a suction cup assembly 165, and a bag sealing mechanism 166. In FIG. 2, in order to show the elements in the bag sealer 16, some parts of the case of the main body 161 are hidden. The entrance opening 162 is located above and connected to the main body 161. The ice cubes slid through the ice guiding trough 172 are received by the entrance opening 162 and dropped into the interior of the main body 161. The reel 163 further includes a roller, on which the plastic bags on a roll 2 are wound. Some parts of the plastic bags on a roll 2 are hanging in the interior of the main body 161.

The cutting tool 164 is installed in the main body 161. A first electrothermal element 1642 (shown in FIG. 4A), which extends along a first direction D1, is installed in the cutting tool 164. The suction cup assembly 165, including a first suction cup 1651 and a second suction cup 1652, is located below the cutting tool 164. The first suction cup 1651 and the second suction cup 1652 have the same structure, and are facing in the opposite directions to each other. Please refer to FIG. 4A. The bag sealing mechanism 166 is located below the suction cup assembly 165. The bag sealing mechanism 166 includes two crossbars 1661. There is an insulation foam 1663 located in both of the two bars 1661. Furthermore, a second electrothermal element 1662 is disposed in one of the crossbars 1661. The second electrothermal element 1662 is, for example, a strip heater, which extends along the second direction D2 (shown in FIG. 2), perpendicular to the first direction D1. In this embodiment, the bag sealer further includes a bracket 169, on which the suction cup assembly 165 and the bag sealing mechanism 166 are disposed on.

The bag sealer 16 further includes a weighing mechanism 167 and a plurality of motors 168. The motors 168 include a first driving motor 1681, a second driving motor 1682, and a third driving motor 1683. The weighing mechanism 167 is disposed in the main body 161 and below the bag sealing mechanism 166. There is a timing belt 1684 coupled to each motor 168 to drive the corresponding element. For example, the timing belt 1684 is driven to rotate the reel 163 when the first driving motor 1681 is actuated. The bracket 169 is driven by the third driving motor 1683; and the suction cup assembly 165 and the bag sealing mechanism 166 are both disposed on the bracket 169, therefore the suction cup assembly 165 and the bag sealing mechanism 166 are moved along with the driven bracket 169 when the third driving motor 1683 is actuated.

Figure 5:
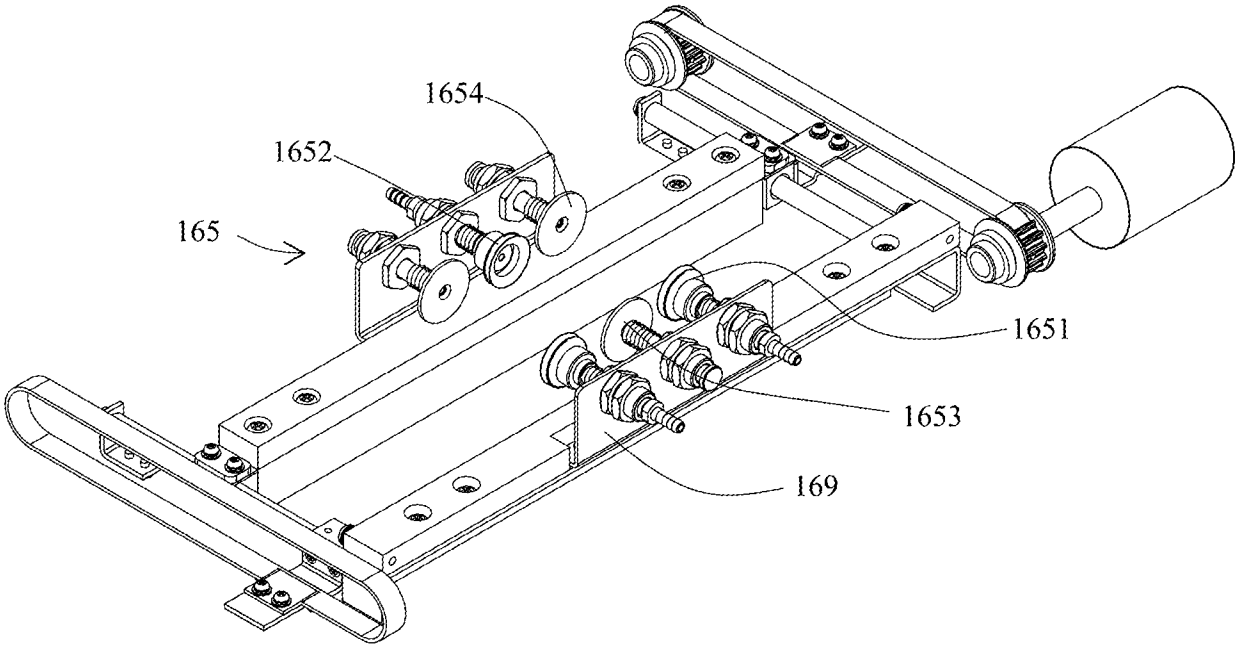
FIG. 5 shows the composition of the suction cup assembly.

Please refer to FIG. 5. FIG. 5 shows the composition of the suction cup assembly. The suction cup assembly 165 further includes a first baffle plate 1653 and a second baffle plate 1654. The first baffle plate 1653 and the second baffle plate 1654 are located on the bracket 169. The first baffle plate 1653 and the first suction cup 1651 are disposed on one side of the bracket 169. The second suction cup 1652 and the second baffle plate 1654 are disposed on the opposite side of the bracket 169. The first suction cup 1651 is facing the second baffle plate 1654 and the second suction cup 1652 is facing the first baffle plate 1653, respectively. The first suction cup 1651 is designed so as not to face the second suction cup 1652. Keep in mind that the first suction cup 1651 and the second suction cup 1652 are mainly comprised of a flexible material, so that if the second suction cup 1652 is facing the first suction cup 1651, the first suction cup 1651 and the second suction cup 1652 may possibly be deformed when they are contacted to each other.

Figure 4A:
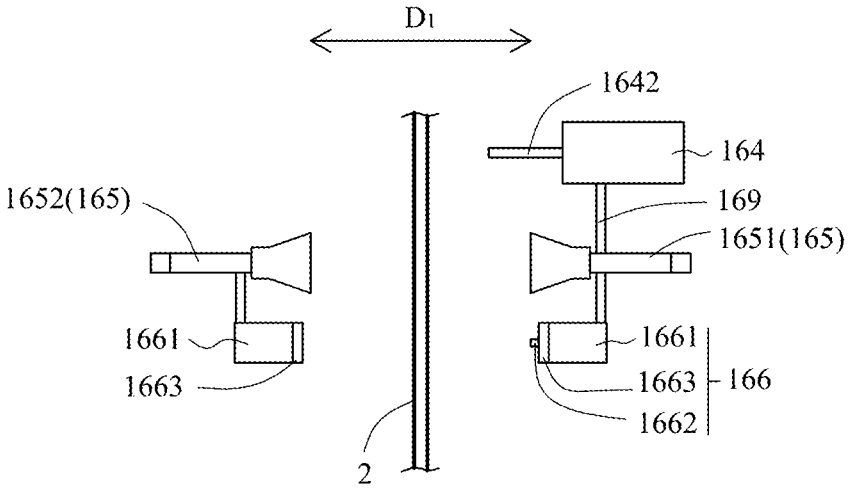
FIG. 4A~FIG. 4D shows the process of packaging ice cubes by the bag sealer.

Please refer to FIG. 2, FIG. 3, and FIG. 4A-FIG. 4D. FIG. 4A~FIG. 4D shows the process of packaging the ice cube by the bag sealer. In FIG. 4A, the plastic bags on a roll 2 is drawn down when the reel 163 is driven and rotated by the first driving motor 1681. When a sensor on the guiding plate 161 detects that the hanging length of the plastic bags on a roll 2 reaches a certain predetermined length, the bracket 169 is driven, so that the first suction cup 1651 and the second suction cup 1652 are moved in opposite directions, and are pressed against the second baffle plate 1654 and the first baffle plate 1653, respectively, to make the hanging portion of the plastic bags on a roll 2 being clamped by the suction cup assembly 165.

Figure 4B:
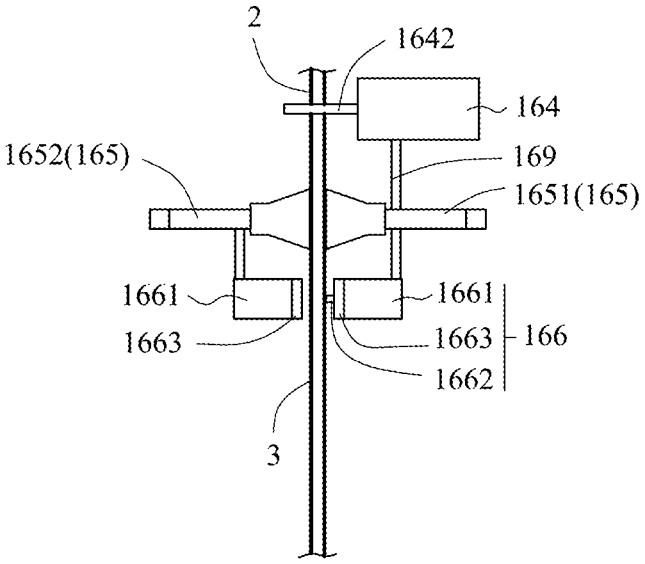
Figure 4C:
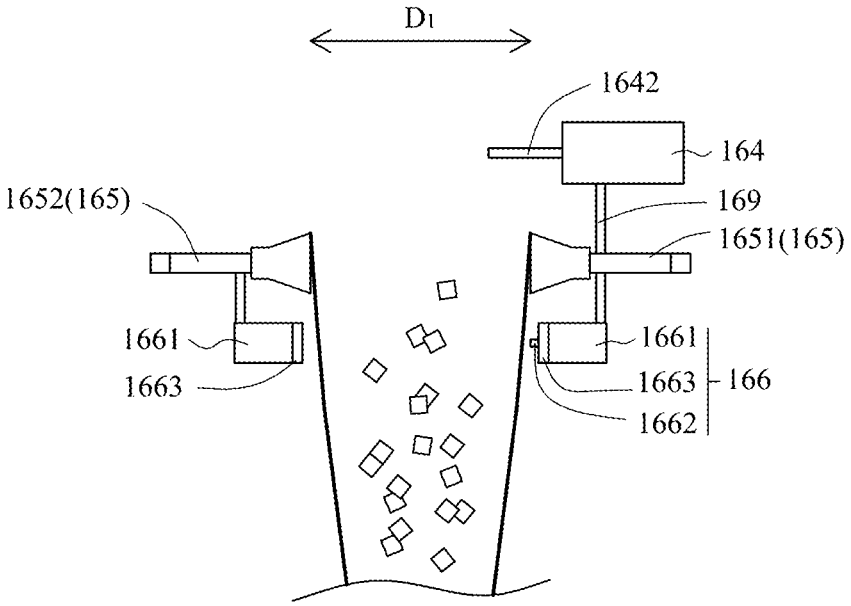

Then, referring to FIG. 4B, when the second driving motor 1682 is actuated, the first electrothermal element 1642 on the cutting tool 164 is driven and moved along the second direction D2. The first electrothermal element 1642 is, for example, a strip heater. By the heat irradiated from the strip heater, the hanging portion of the plastic bags on a roll is cut into a packaging bag 3. In the embodiment, the moving velocity of the first electrothermal element 1642 is between 60 mm/sec and 100 mm/sec. Referring to FIG. 4C, when the driving motor 1683 is actuated, the first suction cup 1651 and the second suction cup 1652 are moved apart from each other, at the same time, the opening of the packaging bag 3 is opened by the suction force of the suction cup assembly 165. Then, the ice cubes are slid down from the entrance opening 162 and dropped into the packaging bag 3.

Figure 4D:
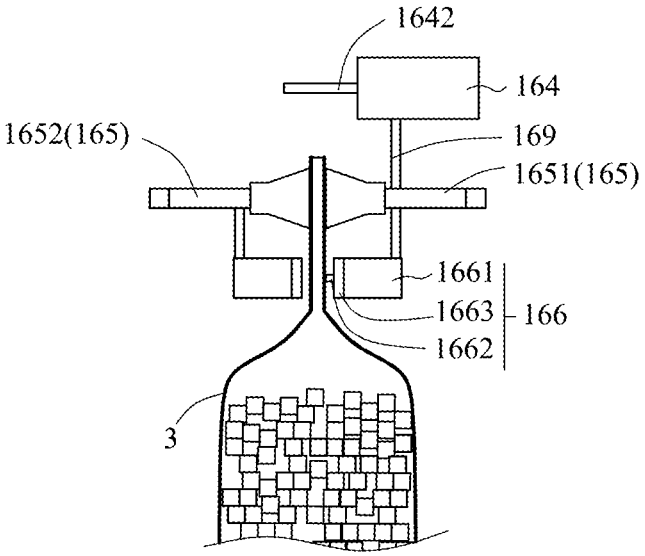

Please refer to FIG. 4D. The operation of filling the ice cube will be stopped when the weighing mechanism detects the weight of the ice cubes in the packaging bag 3 has reached a certain predetermined limit. Then, the third driving motor 1683 is driven again so that the first suction cup 1651 and the second suction cup 1652 are closed in and contacting with the second baffle plate 1654 and the first baffle plate 1653, respectively. In the meantime, the second electrothermal element 1662 and the adiabatic foam 1663 are abutted against each other. Thereafter, the second electrothermal element 1662 is heated to fuse two sides of the opening together, so as to seal the opening of the packaging bag 3. Then, the consumer can remove the packaging bag 3 containing the ice cubes.

Because the ice vending machine 1 has the function of making and packaging ice cubes, the vendor doesn't need to package the ice cubes in one location ahead of time and then delivers the packaged ice cubes to the vending machine. Thus, the vendor can save on the transportation cost and the reduced thermal insulation cost.

In the prior art, the plastic bags on a roll are cut or divided into packaging bags by knife. However, the knife needs more space to perform cutting operation, so it is not suitable to be installed in the vending machine. Because the cutting tool 164 is using the first electrothermal element 1642 to cut the plastic bags on a roll 2, the bag sealer 16 can be made in a more compact manner and installed in the ice vending machine 1. The bag sealer 16 is used for, but not limited to, packaging ice cubes, and it can be used for packaging other products, for example, peanuts or candies. Therefore, the bag sealer 16 can be installed in other types of vending machines or be used independently by itself.

Although the description above contains many specifics, these are merely provided to illustrate the invention and should not be construed as limitations of the invention's scope. Thus it will be apparent to those skilled, in the art that various modifications and variations can be made in the system and processes of the present invention without departing from the spirit or scope of the invention.

What is claimed is:

1. A bag sealer, comprising:

a main body;

an entrance opening positioned above the main body and connected with the main body;

a reel comprising a roller with plastic bags on a roll wound on the roller, such that some part of the plastic bags hang downwardly from the roll in the interior of the main body;

a cutting tool disposed in the main body, the cutting tool including a first electrothermal element which extends along a first direction and is configured to move along a second direction, the second direction perpendicular to the first direction;

a suction cup assembly disposed in the main body and below the cutting tool, the suction cup assembly comprising a first suction cup and a second suction cup, both made of a flexible material, the first suction cup and the second suction cup facing in the opposite directions to each other, both the first suction cup and the second suction cup being configured to move along the first direction; and a bag sealing mechanism comprising a second electrothermal element and positioned below the suction cup assembly, and the second electrothermal element extending along the second direction;

a weighing mechanism disposed in the main body and positioned below the bag sealing mechanism.

2. A bag sealer as claimed in claim 1, further comprising a first driving motor, wherein the first driving motor is used for driving and rotating the reel.

3. A bag sealer as claimed in claim 1, further comprising a second driving motor, wherein the second driving motor is used for driving the cutting tool and making the first electrothermal element move along the second direction.

4. A bag sealer as claimed in claim 3, further comprising a third driving motor, wherein the third driving motor is used for driving the suction cup assembly so that the first suction cup and the second suction cup move closer to or apart from each other.

5. A bag sealer as claimed in claim 1, further comprising a bracket, wherein the suction cup assembly and the bag sealing mechanism are disposed on the bracket, the suction cup assembly and the bag sealing mechanism are moved together when the bracket is driven.

6. A bag sealer as claimed in claim 5, wherein a first baffle plate and a second baffle plate are disposed on the bracket, the first baffle plate and the first suction cup are disposed on the one side of the bracket, the second baffle plate and the second suction cup are disposed on the opposite side of the bracket, the first suction cup is facing the second baffle plate and the second suction cup is facing the first baffle plate.

7. A bag sealer as claimed in claim 1, wherein the bag sealing mechanism further comprises an insulation flexible material, the insulation flexible material and the second electrothermal element are facing each other, and when the bag sealer is actuated, the second electrothermal element and the insulation flexible material are closer to and contacted with each other.

8. A bag sealer as claimed in claim 7, wherein the insulation flexible material is insulation foam.

9. A bag sealer as claimed in claim 1, wherein the moving velocity of the first electrothermal element is between 60 mm/sec and 100 min/sec.

10. An ice vending machine, comprising:

an ice making module:

an ice storage bin located below the ice making module and used for storing the ice manufactured from the ice making module;

a bag sealer; and an ice guiding mechanism disposed between the ice storage bin and the bag sealer, the ice guiding mechanism used for guiding the ice from the ice storage bin into the bag sealer;

wherein the bag sealer comprises:

a main body;

an entrance opening positioned above the main body and connected with the main body;

a reel comprising a roller with plastic bags on a roll wound on the roller, such that some part of the plastic bags hang downwardly from the roll in the interior of the main body;

a cutting tool disposed in the main body, the cutting tool including a first electrothermal element which extends along a first direction and is configured to move along a second direction, the second direction perpendicular to the first direction:

a suction cup assembly disposed in the main body and below the cutting tool, the suction cup assembly comprising a first suction cup and a second suction cup, both made of a flexible material, the first suction cup and the second suction cup facing in the opposite directions to each other, both the first suction cup and the second suction cup being configured to move along the first direction; and a bag sealing mechanism comprising a second electrothermal element and being positioned below the suction cup assembly, and the second electrothermal element extending along the second direction, a weighing mechanism disposed in the main body and positioned below the bag sealing mechanism.

11. An ice vending machine as claimed in claim 10, wherein the ice making module comprises: an inlet pipe, the inlet pipe is used for inputting liquid water; and a condenser, the liquid water is filled into and condensed in the condenser.

12. An ice vending machine as claimed in claim 11, wherein the ice guiding mechanism comprises:

an ice guiding trough, the ice guiding trough is located between the ice storage bin and the entrance opening of the bag sealer; and a hob cutter, the hob cutter is disposed at the inlet of the ice guiding trough, the ice in the ice storage bin is delivered into the ice guiding trough when the hob cutter is rotated.

13. A bag sealer, comprising:

a main body;

an entrance opening positioned above the main body and connected with the main body;

a reel comprising a roller with plastic bags on a roll wound on the roller, such that some part of the plastic bags hang downwardly from the roll in the interior of the main body;

a cutting tool disposed in the main body, the cutting tool including a first electrothermal element which extends along a first direction and is configured to move along a second direction, the second direction perpendicular to the first direction;

a suction cup assembly disposed in the main body and below the cutting tool, the suction cup assembly comprising a first suction cup and a second suction cup, both made of a flexible material, the first suction cup and the second suction cup facing in the opposite directions to each other, both the first suction cup and the second suction cup being configured to move along the first direction; and a bag sealing mechanism comprising a second electrothermal element and positioned below comprising the suction cup assembly, and the second electrothermal element extending along the second direction;

a weighing mechanism disposed in the main body and positioned below the bag sealing mechanism;

a first driving motor, used for driving and rotating the reel;

a second driving motor, used for driving the cuffing tool and making the first electrothermal element move along the second direction;

a third driving motor used for driving the suction cup assembly so that the first suction cup and the second suction cup move closer to or apart from each other;

a bracket, wherein the suction cup assembly and the bag sealing mechanism are disposed on the bracket, the suction cup assembly and the bag sealing mechanism are moved together when the bracket is driven;

a first baffle plate and a second baffle plate, wherein the first baffle plate and the first suction cup are disposed on the one side of the bracket, the second baffle plate and the second suction cup are disposed on the opposite side of the bracket, the first suction cup is facing the second baffle plate and the second suction cup is facing the first baffle plate;

wherein the bag sealing mechanism further comprises an insulation flexible material, the insulation flexible material and the second electrothermal element are facing each other, and when the bag sealer is actuated, the second electrothermal element and the insulation flexible material are closer to and contacted with each other.

* * * * *